US006611069B1

(12) United States Patent
Wang

(10) Patent No.: US 6,611,069 B1
(45) Date of Patent: Aug. 26, 2003

(54) POWER SUPPLY STATUS CONTROL CIRCUIT OF ELECTRICAL OUTLET SET DESIGNED FOR USE WITH COMPUTER AND PERIPHERAL APPARATUS

(76) Inventor: Peace Wang, No. 111-4, Lane 167, Ts'U Hsiu No Road, Chang Hua City, Chang Hua Hsien (TW)

( * ) Notice: Subject to any disclaimer, the term of this patent is extended or adjusted under 35 U.S.C. 154(b) by 130 days.

(21) Appl. No.: 09/717,085

(22) Filed: Nov. 22, 2000

Related U.S. Application Data

(63) Continuation-in-part of application No. 09/313,645, filed on May 18, 1999, now abandoned.

(51) Int. Cl.[7] ..... H01H 43/04
(52) U.S. Cl. ..... 307/125; 307/38
(58) Field of Search ..... 307/38, 39, 125

(56) References Cited

U.S. PATENT DOCUMENTS 4,025,841 A * 5/1977 Chambers et al. ..... 323/268
4,531,083 A * 7/1985 Hoffman ..... 320/128
4,659,941 A * 4/1987 Quiros et al. ..... 307/38
4,820,964 A * 4/1989 Kadah et al. ..... 318/786
4,970,623 A * 11/1990 Pintar ..... 307/38
5,099,157 A * 3/1992 Meyer ..... 307/38
5,120,983 A * 6/1992 Samann ..... 307/38
5,270,576 A * 12/1993 Kahle ..... 307/125
5,281,822 A * 1/1994 Albrecht et al. ..... 250/370.05
5,541,457 A * 7/1996 Morrow ..... 307/38
5,579,201 A * 11/1996 Karageozian ..... 307/38
5,598,039 A * 1/1997 Weber ..... 307/38
5,615,107 A * 3/1997 DeAngelis ..... 307/38
5,731,947 A * 3/1998 Hirose ..... 307/38
5,955,791 A * 9/1999 Irlander ..... 307/38
6,222,285 B1 * 4/2001 Haley et al. ..... 307/125

FOREIGN PATENT DOCUMENTS

JP 2000-295777 * 10/2000 ..... H02J/7/00

* cited by examiner

*Primary Examiner*—Brian Sircus
*Assistant Examiner*—Roberto J. Rios
(74) *Attorney, Agent, or Firm*—Browdy and Neimark, P.L.L.C.

(57) ABSTRACT

A power supply status control circuit used in an electric outlet set having a main receptacle and multiple auxiliary receptacles, including a DC power circuit, a fuse, the fuse having a first end and a second end respectively connected to one end of the main receptacle of the electric outlet set and one end of AC power supply, an amplifier connected with its input end to the second end of the fuse, a comparator connected with its input end to the output end of the amplifier, and an electrically-controlled switch unit connected between the second end of the main receptacle and the second end of each auxiliary receptacle the electrically-controlled switch unit having a signal input end connected to the output end of the comparator to receive the output voltage of the comparator for on/off control. When the computer at the main receptacle is shut down, the auxiliary receptacles are electrically disconnected from the main receptacle to automatically turn off the peripheral apparatus.

2 Claims, 3 Drawing Sheets

POWER SUPPLY STATUS CONTROL CIRCUIT OF ELECTRICAL OUTLET SET DESIGNED FOR USE WITH COMPUTER AND PERIPHERAL APPARATUS

This is a continuation-in-part of application Ser. No. 09/313,645, filed May 18, 1999, abandoned.

BACKGROUND OF THE INVENTION

1. Field of the Invention

The present invention relates to an electrical outlet set and, more particularly, to a power supply status control circuit of electrical outlet set, which is designed for use with a computer and the related peripheral apparatus.

2. Description of the Prior Art

A conventional electrical outlet set for use with a computer is generally comprised of a main receptacle and a plurality of auxiliary receptacles connected in parallel to the main receptacle. After connection of the electrical outlet set, the main and auxiliary receptacles provide the necessary working voltage to the computer and the related peripheral apparatus (modem, printer, and etc.) installed therein. However, this conventional electrical outlet set provides only one single power supply status, i.e., all the receptacles are maintained electrically connected after connection of the electrical outlet set to city power supply. Therefore, when the computer that is connected to the main receptacle is shut down, the peripheral apparatus that are respectively connected to the auxiliary receptacles must be separately turned off.

FIG. 1 shows an electrical outlet set according to the prior art. This structure of electrical outlet set 1 comprises a plurality of receptacles 2, and a plurality of on/off switches 3 adapted to switch on/off the receptacles 2 respectively. After each use of the computer, the user controls the on/off switches 3 to turn off the respective peripheral apparatus. This manual peripheral apparatus control operation is still inconvenient. The peripheral apparatus cannot be automatically turned off when shutting down the computer.

SUMMARY OF THE INVENTION

The present invention has been accomplished under the circumstances in view. It is the main object of the present invention to provide a power supply status control circuit for an electrical outlet set, which automatically switches off all auxiliary receptacles when the user shuts down the computer at the main receptacle. The power supply status control circuit of the present invention is used in an electric outlet set for computer, the electric outlet set comprising a main receptacle and a plurality of auxiliary receptacles, the main receptacle and the auxiliary receptacles each having a first end and a second end respectively connected to two opposite ends of AC power supply. The power supply status control circuit comprises a DC power circuit connected to AC power supply and adapted to convert AC power supply into DC power supply (VCC) for output; a first fuse, the fuse having a first end and a second end respectively connected to the second end of the main receptacle and one end of AC power supply, the fuse having a predetermined resistance value; an amplifier adapted to amplify the voltage value of the electricity passing through the first fuse, the amplifier having an input end connected to the second end of the first fuse and an output end; a comparator adapted to compare the voltage value of the electric current passing through the first fuse with a reference voltage, the comparator having an input end connected to the output end of the amplifier and an output end for output of comparison result; an electrically-controlled switch unit connected between the second end of the main receptacle and the second end of each of the auxiliary receptacles, the electrically-controlled switch unit comprising a signal input end connected to the output end of the comparator to receive the output voltage of the comparator for on/off control. When the electric apparatus at the main receptacle is turned off, the electrically controlled switch unit is switched off, thereby causing the second end of each of the auxiliary receptacles to be electrically disconnected from the second end of the main receptacle. When the electric apparatus at the main receptacle is turned on, the electrically controlled switch unit is switched on, thereby causing the second end of each of the auxiliary receptacles to be electrically connected to the second end of the main receptacle for enabling the auxiliary receptacles to obtain power supply.

DETAILED DESCRIPTION OF THE PREFERRED EMBODIMENT

Figure 1:
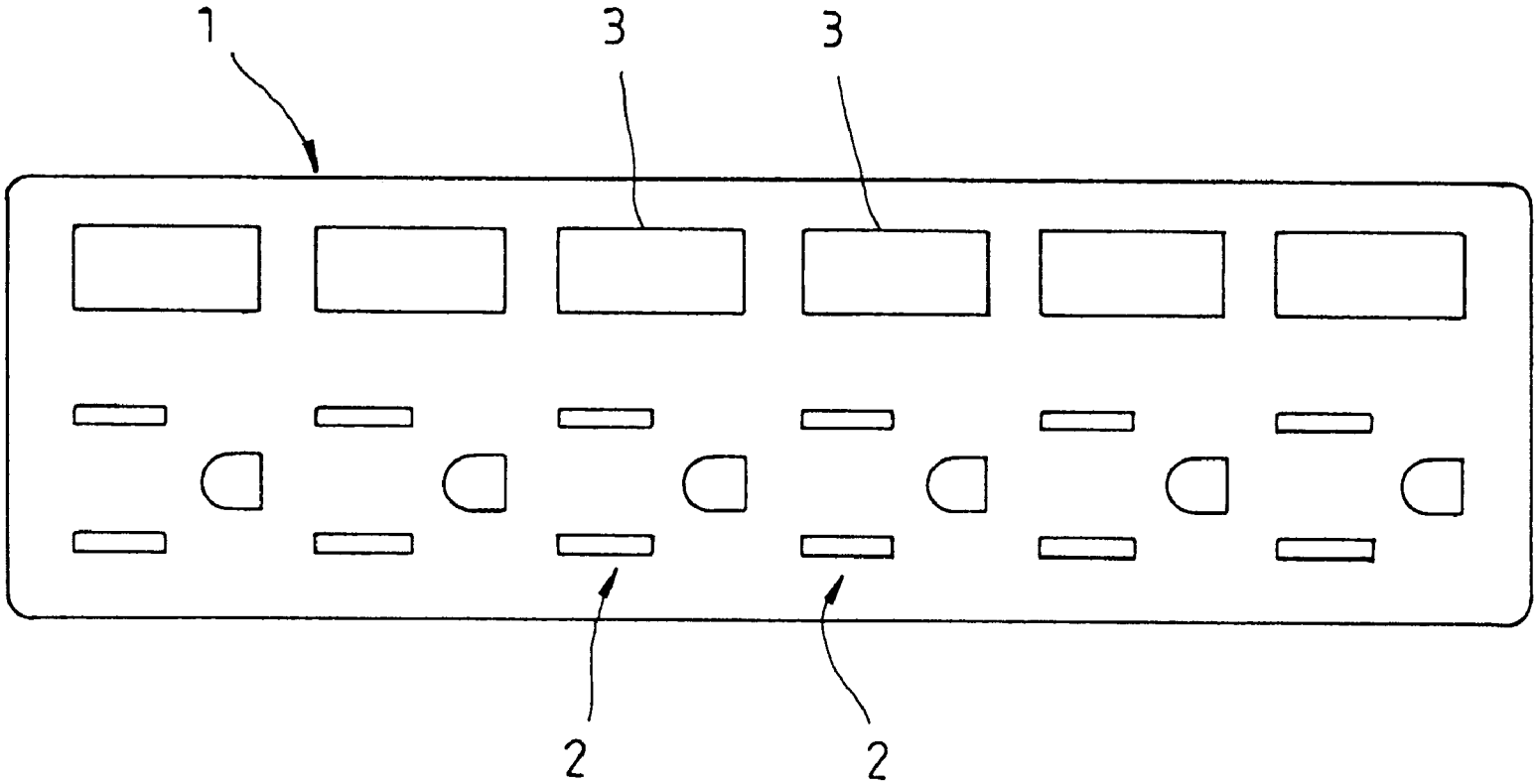
FIG. 1 PRIOR ART
FIG. 1 is a plain view of the face panel of an electric outlet set according to the prior art.
Figure 2:
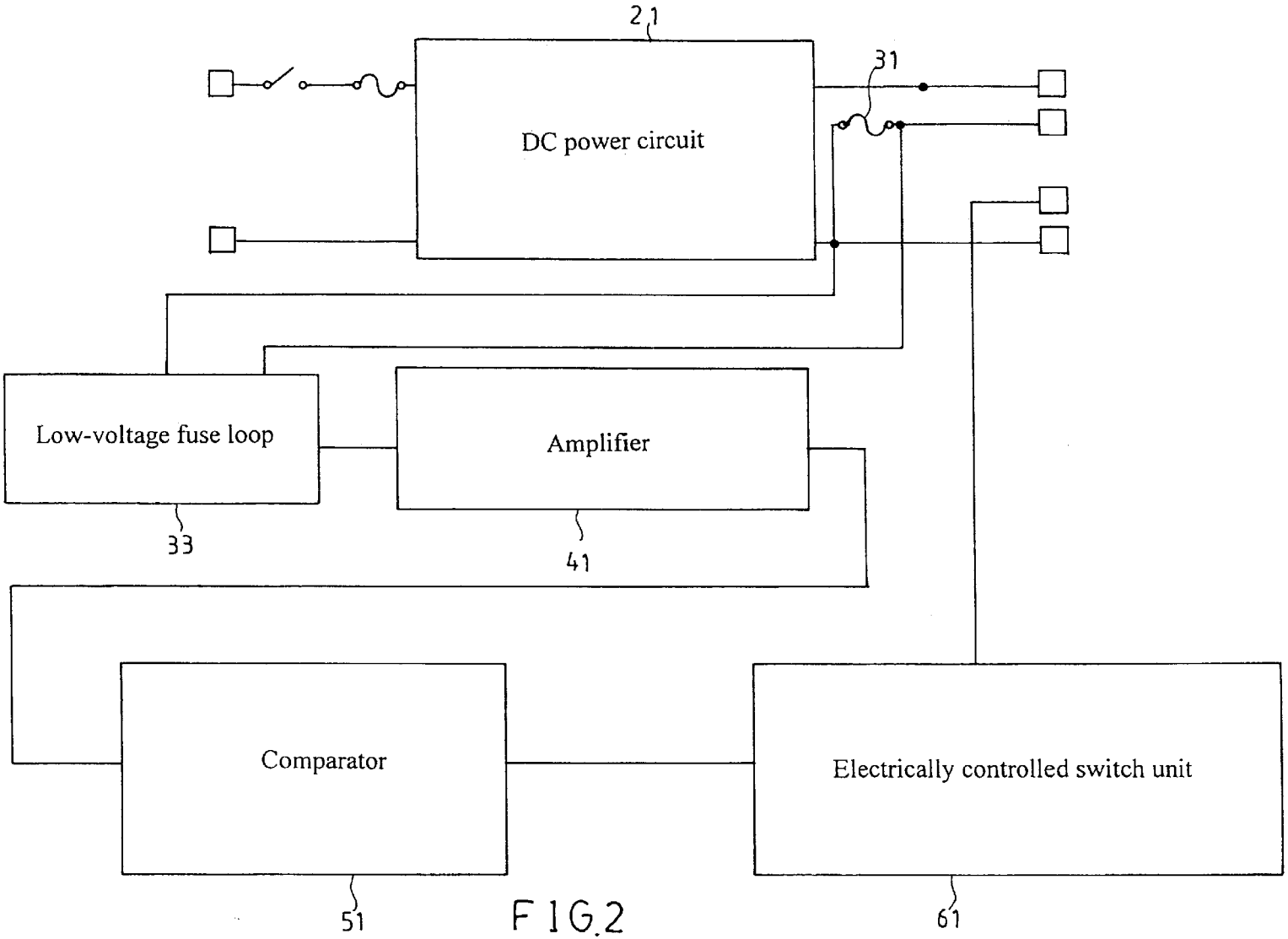
FIG. 2 is a circuit block diagram of the preferred embodiment of the present invention.
Figure 3:
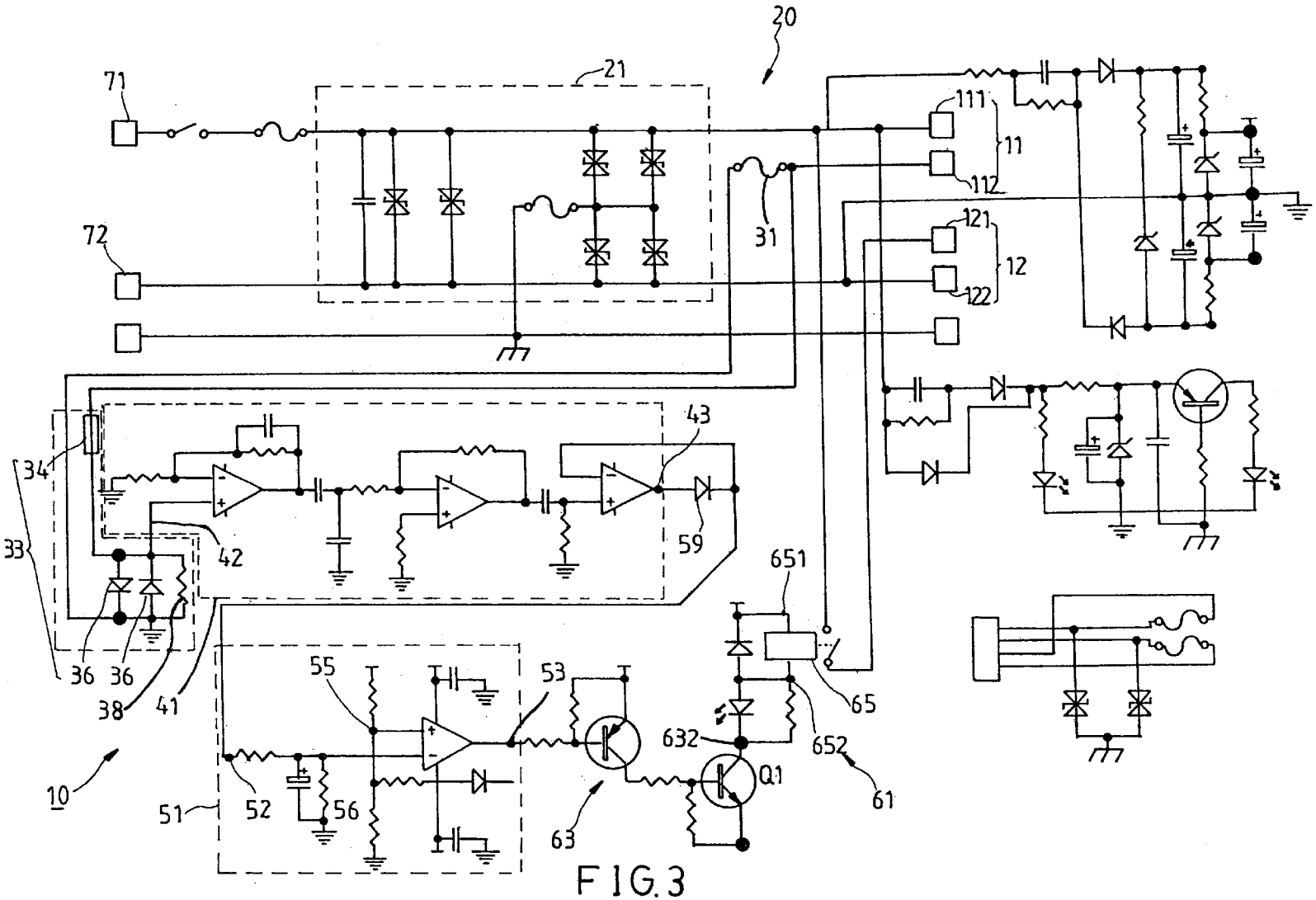
FIG. 3 is a detailed circuit diagram of the preferred embodiment of the present invention.

Referring to FIGS. 2 and 3, a power supply status control circuit 20 is shown used in an electric outlet set 10 for computer. The electric outlet set 10 comprises a plurality of receptacles 12 connected in parallel. The receptacles 12 have a respective second end connected to the second end 72 of AC power supply. The power supply status control circuit 20 is comprised of a DC power circuit 21, a fuse 31, a low-voltage fuse loop 33, an amplifier 41, a comparator 51, and an electrically controlled switch unit 61.

The DC power circuit 21 is connected to the first and second ends (converter and non-converter terminals) 71 and 72 of city power supply, and adapted to convert AC power supply into stable DC power supply (VCC) for output.

The fuse 31 has a predetermined resistance value, having one end connected to the second end 112 of the main receptacle 11 of the electric outlet set 10 and an opposite end connected to the second end 72 of AC power supply. The first end 111 of the main receptacle 11 is connected to the first end 71 of AC power supply.

The low-voltage fuse loop 33 is comprised of a second fuse 34, two diodes 36, and a resistor 38. The second fuse 34 has a first end connected to the second end 112 of the main receptacle 11, and a second end connected to the amplifier 41. The diodes 36 are reversely connected in parallel, each having one end connected to the first end of the first fuse 31 and an opposite end connected to the second end of the second fuse 34.

The amplifier 41 has its input end 42 connected to the second end of the second fuse 34, and is adapted to amplify the voltage value of the electricity passing through its input end 42 for output through its output end 43.

The comparator 51 has its input end 52 connected to the output end 43 of the amplifier 41 through a diode 59, and is adapted to compare voltage values of points 55 and 56 and to output the comparison result through its output end 53. The diode 59 is connected in series between the input end 52 of the comparator 51 and the output end 43 of the amplifier 41, and adapted to rectify and filter electric current passing through.

The electrically controlled switch unit 61 comprises a composite transistor amplifier 63, and a relay 65. The base 63 of the transistor Q2 of the composite transistor amplifier 63 is connected to the output end 53 of the comparator 51. The relay 65 has its two signal input ends 651 and 652 respectively connected to VCC and the collector 632 of the transistor Q1 of the composite transistor amplifier 63, its on-off switching ends respectively connected to the second end 112 of the main receptacle 11 and the second end 122 of each auxiliary receptacle 12.

When the computer is off, the main receptacle 11 is disconnected from power supply, the voltage value at the input end 42 of the amplifier 41 is 0 V, and the voltage value at the output end 43 of the amplifier 41 is also 0 V, and therefore the input end 52 of the comparator 51 receives 0 V and the voltage value at the output end 53 of the comparator 51 is also 0 V. At this time, the composite transistor amplifier 63 is off, the relay 65 is maintained in the open-circuit status, thereby causing the second end 122 of each auxiliary receptacle 12 unable to be connected to the second end 112 of the main receptacle 11, and therefore the auxiliary receptacles 12 are off, the peripheral apparatus at the auxiliary receptacles 12 are also off.

When turning on the computer, electric current passes through the computer and the fuse 31, causing the fuse 31 to produce a voltage drop, therefore the amplifier 41 amplifies the voltage value of the electric current passed to its input end 42 for further output through its output end 43. At this time, the comparator 51 compares the voltage value at the point 55 with the voltage value at point 56, and outputs "high" signal to turn on the composite transistor amplifier 63 when the voltage value at the point 55 surpassed the voltage value at the point 56. After the composite transistor amplifier 63 has been turned on, the collector 632 is grounded, the signal input ends of the relay 65 are turned on, and the on-off switching ends of the relay 65 are electrically connected, therefore the second end 112 of the main receptacle 11 is connected to the second end 122 of each auxiliary receptacle 12, the auxiliary receptacles 12 which are respectively connected to the first end 71 of AC power supply are electrically connected, and all the peripheral apparatus that are respectively connected to the auxiliary receptacles 12 can thus obtained power supply. Therefore, when turning on the computer, all the peripheral apparatus are automatically electrically connected for operation.

When shutting down the computer after each use, the main receptacle 11 is off. At this time, the voltage value at the input end 42 of the amplifier 41 is 0 V, the relay 65 is off, and therefore the auxiliary receptacles 12 are off, and all the peripheral apparatus that are connected to the auxiliary receptacles 12 are electrically disconnected, i.e., the peripheral apparatus are automatically electrically disconnected when shutting down the computer.

According to the present invention, the fuse is used to detect the load, and is resistive against impact of electric current. It burns out to cut off electric current upon an overload, so as to protect the component parts of the circuit and prevent short-circuit. Further, the fuse, the second fuse, the diodes and the resistor form a protective loop. Normally, the diodes are off. When the fuse is burned out due to an overload, the diodes are electrically connected, and at this time, the second fuse is burned out due to an overcurrent, and therefore the amplifier is well protected from an overcurrent. Without the second fuse and the diodes, an overcurrent will pass to the amplifier when the fuse is burned out, causing the amplifier to be destroyed.

Further, the amplifier is a three-stage OP, which forms with the comparator a 4-stage OP that improves the stability of the limit of electric current.

It is to be understood that the drawings are designed for purposes of illustration only, and are not intended for use as a definition of the limits and scope of the invention disclosed.

What the invention claimed is:

1. A power supply status control circuit used in an electric outlet set for computer, said electric outlet set comprising a main receptacle and a plurality of auxiliary receptacles, said main receptacle and said auxiliary receptacles each having a first end and a second end respectively connected to two opposite ends of AC power supply, said power supply status control circuit comprising:

a DC power circuit connected to AC power supply and adapted to convert AC power supply into a DC power supply (VCC) for output;

a first fuse, said fuse having a first end and a second end respectively connected to the second end of said main receptacle and ground, said fuse having a predetermined resistance value;

an amplifier adapted to amplify the voltage value of the electricity passing through said first fuse, said amplifier having an input end connected to the second end of said first fuse and an output end;

a comparator adapted to compare the voltage value of the electric current passing through said first fuse with a reference voltage, said comparator having an input end connected to the output end of said amplifier and an output end for output of comparison result;

an electrically-controlled switch unit connected between the second end of said main receptacle and the second end of said auxiliary receptacles, said electrically-controlled switch unit comprising a signal input end connected to the output end of said comparator to receive the output voltage of said comparator for on-off control; and a low-voltage fuse loop formed of a second fuse, two diodes reversely connected in parallel, and a resistor connected in parallel to said diodes, said second fuse having a first end connected to the second end of said main receptacle and a second end connected to the input end of said amplifier, said diodes each having one end connected to the first end of said first fuse and an opposite end connected to the second end of said second fuse, wherein when the electric apparatus at said main receptacle is turned off, said electrically-controlled switch unit is switched off, thereby causing the second end of each of said auxiliary receptacles to be electrically disconnected from the second end of said main receptacle; when the electric apparatus at said main receptacle is turned on, said electrically-controlled switch unit is switched on, thereby causing the second end of each of said auxiliary receptacles to be electrically connected to the second end of said main receptacle for enabling said auxiliary receptacles to obtain power supply.

2. The power supply status control circuit of claim 1, wherein said electrically controlled switch unit comprises a composite transistor amplifier and a relay.

* * * * *